US009863252B2

(12) United States Patent
Merlot et al.

(10) Patent No.: US 9,863,252 B2
(45) Date of Patent: Jan. 9, 2018

(54) SINGLE-PIECE BLISK FOR TURBOMACHINE FAN COMPRISING AN UPSTREAM AND/OR DOWNSTREAM RECESS MAKING ITS BLADES MORE FLEXIBLE

(71) Applicant: Snecma, Paris (FR)

(72) Inventors: Damien Merlot, Vaux le Penil (FR); Etienne Ide, Beauvais (FR); Philippe Gérard Edmond Joly, Vaux le Penil (FR)

(73) Assignee: SNECMA, Paris (FR)

( * ) Notice: Subject to any disclaimer, the term of this patent is extended or adjusted under 35 U.S.C. 154(b) by 273 days.

(21) Appl. No.: 14/942,106

(22) Filed: Nov. 16, 2015

(65) Prior Publication Data

US 2016/0138403 A1 May 19, 2016

(30) Foreign Application Priority Data

Nov. 17, 2014 (FR) ..... 14 61070

(51) Int. Cl.
*F01D 5/14* (2006.01)
*F01D 5/34* (2006.01)
*F04D 29/32* (2006.01)

(52) U.S. Cl.
CPC ..... *F01D 5/141* (2013.01); *F01D 5/34* (2013.01); *F04D 29/321* (2013.01); (Continued)

(58) Field of Classification Search
CPC . F01D 5/141; F01D 5/147; F01D 5/34; F01D 5/12; F01D 5/14; F01D 5/30; (Continued)

(56) References Cited

U.S. PATENT DOCUMENTS 2,479,039 A * 8/1949 Val Cronstedt ..... F01D 5/021 164/333
2,657,902 A 11/1953 Williams
(Continued)

FOREIGN PATENT DOCUMENTS

| | | |
|---|---|---|
| EP | 2 738 392 A2 | 6/2014 |
| JP | 2009-197649 A | 9/2009 |
| WO | 2013/050724 A1 | 4/2013 |

OTHER PUBLICATIONS

Search Report issued in French Patent Application No. FR 1461070 dated Sep. 2, 2015.

*Primary Examiner* — Dwayne J White
*Assistant Examiner* — Sang K Kim
(74) *Attorney, Agent, or Firm* — Pearne & Gordon LLP

(57) ABSTRACT

The invention relates to a single-piece fan blisk (14) for a turbojet, this blisk (14) comprising a hub (16) with a general shape of revolution about a rotation axis (AX) and comprising an external peripheral face (18) of revolution extending radially towards the rotation axis at an upstream face (19) and a downstream face both of which are in the form of rings. This hub (16) supports radially oriented blades (17) at its external peripheral face (18), each comprising a base through which it is connected to this external peripheral face (18), each blade (17) having a leading edge (22) and a trailing edge (23) that are radially oriented. The spacing between the upstream face (19) and the downstream face of the hub (16) along the rotation axis (AX) is less than the distance separating the leading edge (22) from the trailing edge (23) of each blade.

6 Claims, 3 Drawing Sheets

(52) U.S. Cl.
CPC ..... *F04D 29/329* (2013.01); *F05D 2220/36* (2013.01); *F05D 2230/53* (2013.01); *F05D 2240/303* (2013.01); *F05D 2240/304* (2013.01); *F05D 2260/941* (2013.01)

(58) Field of Classification Search
CPC ..... F01D 5/3061; F05D 2230/53; F05D 2240/304; F05D 2240/303; F05D 2220/36; F05D 2260/941; F04D 29/321; F04D 29/329
See application file for complete search history.

(56) References Cited

U.S. PATENT DOCUMENTS

| | | | | |
|---|---|---|---|---|
| 5,108,261 | A | 4/1992 | Ress, Jr. | |
| 5,480,284 | A | 1/1996 | Wadia | |
| 5,594,288 | A * | 1/1997 | Husain | F01D 5/028 310/62 |
| 2015/0176415 | A1 | 6/2015 | Nucci | |
| 2015/0267545 | A1 | 9/2015 | Merlot | |

* cited by examiner

SINGLE-PIECE BLISK FOR TURBOMACHINE FAN COMPRISING AN UPSTREAM AND/OR DOWNSTREAM RECESS MAKING ITS BLADES MORE FLEXIBLE

TECHNICAL DOMAIN

The invention relates to a fan disk of a turbojet type engine, this disk being a single-piece blisk, in other words it comprises a hub and blades that form a single indissociable part.

STATE OF PRIOR ART

A twin spool turbofan type engine 1 like that in FIG. 1, comprises an air intake 2 in which air is inlet before being drawn in by the blades of a fan 3. After passing through the fan region, air is divided into a central core engine flow and a fan flow surrounding the core engine flow.

The core engine flow passes through a low pressure compressor 4 located immediately after the fan 3 while the fan flow is forced backwards to generate an additional thrust directly by being blown around the core engine flow.

The core engine flow then flows through a high pressure compressor 6, before reaching a chamber 7 in which its combustion takes place, after injection and atomisation of a fuel. After combustion, this core engine flow expands in a high pressure turbine 8 and then in a low pressure turbine to rotate the compression stages and the fan, before being expelled towards the rear of the engine to generate a thrust.

Each turbine and each compressor comprises a sequence of stages each comprising a series of blades oriented radially and at a uniform spacing around an engine rotation shaft. This central shaft or rotor that extends along a longitudinal AX axis supports the rotating elements of the turbine and the rotating elements of the compressor and the fan.

The fan blades may be elements added onto a disk called the fan disk that is firstly fixed for example by a splined connection to the engine shaft. After the disk has been fixed, the blades are fitted from the front of the disk by engaging them in longitudinal grooves formed around the periphery of the disk and that are called slots.

In the case of a fan with a single-piece blisk, the series of fan blades is fitted on a hub forming a single and indissociable part with it.

A part of such a single blisk corresponding to an angular sector around the AX axis is shown diagrammatically in FIG. 2 and is referenced as mark 11. The hub 12 of this blisk is connected to the blades 3 at regions mark 13 corresponding to the low parts of these blades.

If a foreign body is ingested into the turbojet, the foreign body collides firstly with a set of fan blades, giving rise to a mechanical stress that can cause degradation of one or several blades, or a blade may even be torn off.

In the case of a single-piece blisk, as in the case shown in FIG. 2, ingestion of a foreign body creates a mechanical stress concentration that is maximum at the base 13 of the impacted blades, in other words at the junction of each of these blades 3 with the hub 12.

This situation is due to the fact that the single-piece structure increases the stiffness of the blades 3 at their connection 13 with the hub 12 forming the disk. This tends to increase the mechanical stress when the blades 3 are highly loaded in bending, which is the case when a foreign body is ingested. A blade can be torn off due to this stress concentration at the bottom of the blade.

The purpose of the invention is to disclose a solution for reducing the stress at the bottom of a blade, particularly following ingestion of a foreign body.

PRESENTATION OF THE INVENTION

The invention relates to a single-piece fan blisk for a turbofan such as a turbojet, this single-piece blisk comprising a hub with a general shape of revolution about a rotation axis, this hub comprising an external peripheral face extending radially towards the rotation axis at an upstream face and a downstream face both of which are in the form of rings, this hub supporting blades each comprising a base through which it is connected to an external peripheral face and a leading edge and a trailing edge that are radially oriented, characterised in that the spacing between the upstream and the downstream face is less than the distance separating the leading edge from the trailing edge of each blade along the rotation axis.

The length of the anchorage of blades in the hub of the single-piece blisk is thus reduced to increase the flexibility of the blade about the rotation axis and about a radial axis to facilitate absorption of energy resulting from a shock. This arrangement thus significantly reduces stresses at the bottom of the blades without modifying their geometry relative to the fluid flow in the jet in operation.

The invention also relates to a blisk thus defined, in which the upstream face of the hub is located along the rotation axis between the leading edges of the blades and the trailing edges of the blades, and in which each blade comprises a prolongation on the side of its leading edge towards the rotation axis through which it is connected to the upstream face.

The invention also relates to a blisk thus defined, in which the downstream face of the hub is located along the rotation axis between the leading edges of the blades and the trailing edges of the blades, and in which each blade comprises a prolongation on the side of its trailing edge towards the rotation axis through which it is connected to the downstream face.

The invention also relates to a blisk thus defined, in which the ratio of the length separating the leading edge of the blade from the upstream face of the hub divided by the length separating the leading edge from the trailing edge of the blade, is between two tenths and four tenths.

The invention also relates to a blisk thus defined, in which the ratio of the length separating the trailing edge of the blade from the downstream face of the hub divided by the length separating the leading edge from the trailing edge of the blade, is between two tenths and four tenths.

The invention also relates to a blisk thus defined, in which the ratio of the sum of the length separating the leading edge of the blade from the upstream face of the hub and the length separating the trailing edge of the blade from the downstream face of the hub, divided by the length separating the leading edge from the trailing edge of the blade, is between two tenths and four tenths.

The invention also relates to a turbofan fan comprising a blisk thus defined.

The invention also relates to a jet engine, comprising a single-piece blisk thus defined.

DETAILED PRESENTATION OF PARTICULAR EMBODIMENTS

Figure 1:
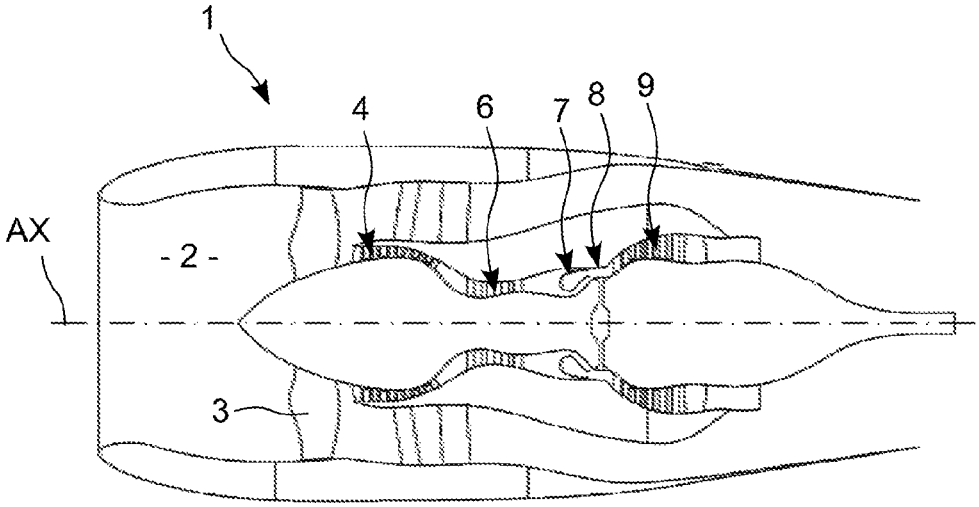
FIG. 1 is a longitudinal sectional overview of a turbojet.
Figure 2:
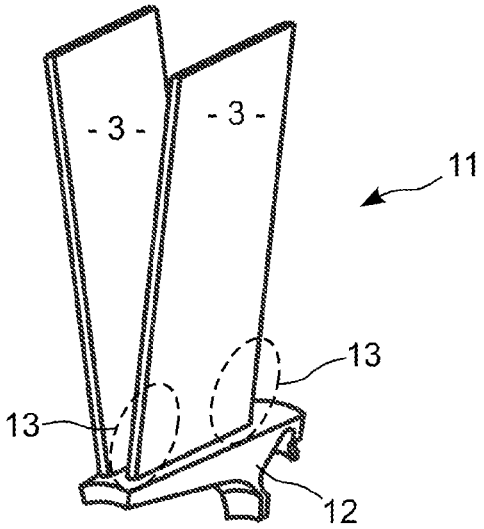
FIG. 2 is a partial view of a single-piece blisk according to the state of the art showing an angular sector of this single-piece disk comprising two blades.
Figure 3:
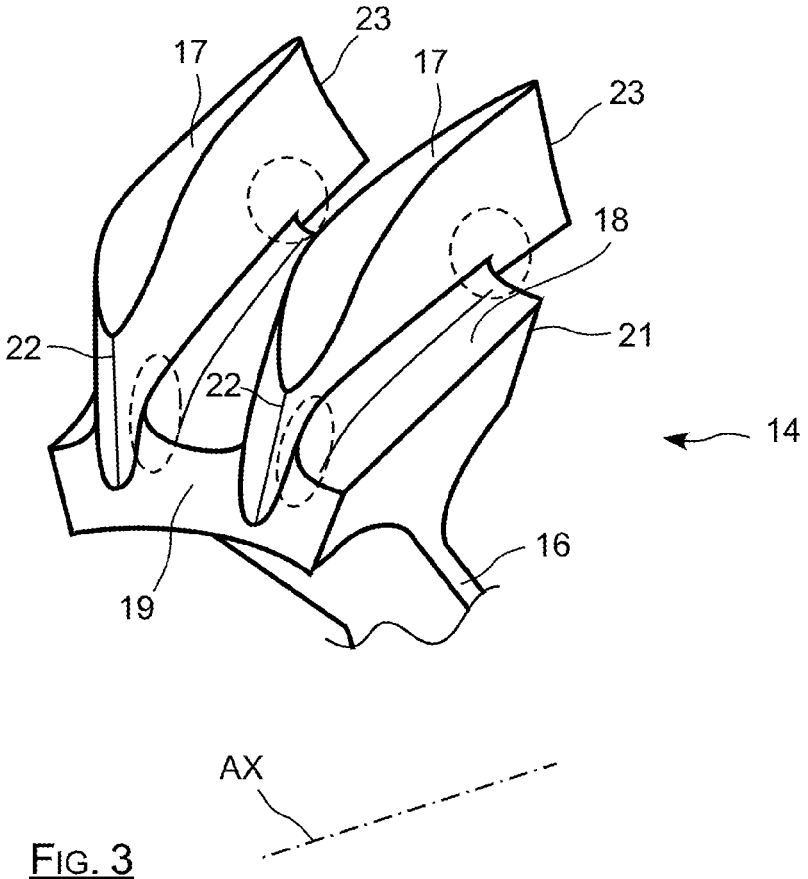
FIG. 3 is a partial three-quarter front view of a single-piece blisk according to the invention showing an angular sector of this single-piece disk comprising two blades.

The single-piece blisk according to the invention that is partially shown in FIG. 3 and that is referenced as mark 14 comprises a hub or rim 16 corresponding to its central portion, and that supports a series of blades. The bases of two of these blades can be seen in FIG. 3 in which they are marked as 17.

The hub 16 that is generally annular in shape extending around its rotation AX axis, forms an assembly with the blades 17 that it supports, in other words a single-piece derived from a single fabrication process such as a three-dimensional milling process.

The hub 16 of the single-piece blisk 14 comprises an external peripheral face 18 with a general shape of revolution about the AX axis, that is tapered in shape in this case, and from which the bases of each blade 17 start, that are at a spacing from each other about the rotation AX axis.

This external peripheral face 18 extends radially upstream towards the AX axis at a ring-shaped upstream face 19, and it extends radially downstream towards the AX axis at a downstream face 21 that is also ring-shaped. The upstream and downstream faces are in the form of approximately plane rings centred on the AX axis and oriented perpendicular to this axis.

Each blade comprises a leading edge 22 and a trailing edge 23, the leading edges being the edges located on the upstream side to face an incident air flow, while the trailing edges are downstream from the leading edges relative to the direction of the air flow passing through the jet.

Figure 4:
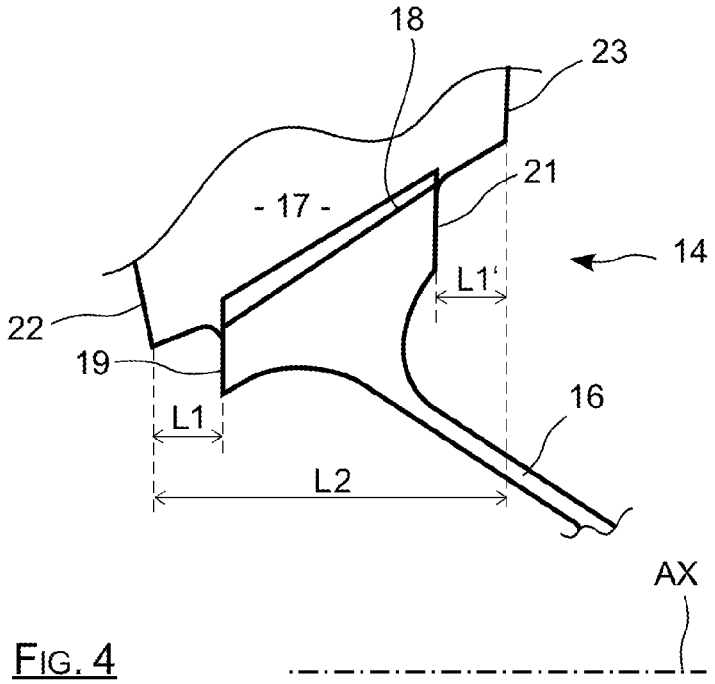
FIG. 4 is a longitudinal sectional view of a blisk according to the invention showing one of its blades and half of the hub supporting this blade.
Figure 5:
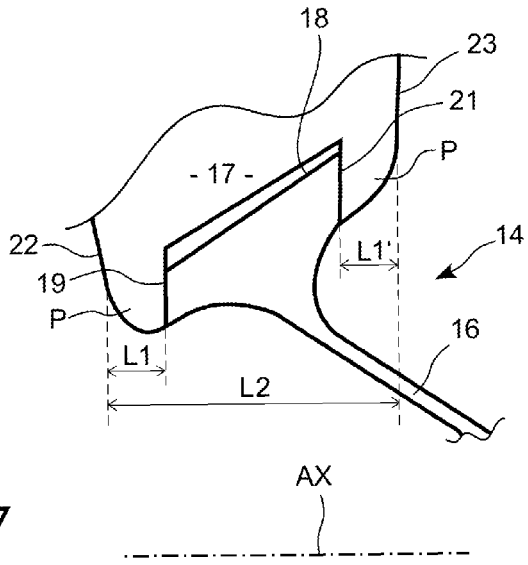
FIG. 5 is a longitudinal sectional view of a blisk according to the invention comprising blades provided with prolongations towards the upstream and downstream faces of the hub.

As can be seen in these FIGS. 3 to 5, the hub 16 is hollowed out at its upstream portion and its downstream portion, such that the upstream face 19 and the downstream face 21 are offset towards the central region relative to the leading edges 22 and the trailing edges 23 of the blades.

Each blade is connected through its base to the external peripheral surface 18 of the hub, but this external peripheral surface 18 is shorter than the blades along the AX axis; the length separating the upstream face from the downstream face is shorter than the length or cord of the blades projected onto the AX axis.

The blade can thus be arranged to go beyond the side of its leading edge 22 by a length L1 separating this leading edge from the upstream face 19, this length L1 thus corresponding to the length of the upstream recess of the hub 18. If the length separating the leading edge 22 from the trailing edge 23 of the blade in the region of the external face of the hub 18 is denoted L2, the proportions of the blade advantageously satisfy the criterion $0.2<L1/L2<0.4$.

The blade may similarly be arranged to project beyond the side of its trailing edge 23 by a length L1' separating this trailing edge from the downstream face 21, this length L1' thus corresponding to the length of the downstream recess of the hub 18. The proportions of the blade advantageously satisfy the criterion $0.2<L1'/L2<0.4$.

When the blade is designed to project beyond the side of its leading edge and also beyond the side of its trailing edge, its proportions are chosen to satisfy the criterion $0.2<(L1+L1')/L2<0.4$.

More specifically, if these length ratios are too small in other words less than two tenths, the gain in flexibility of the blade is insufficient to significantly improve its resistance to shocks. On the other hand, when these length ratios are too high, in other words more than four tenths, the suppleness or flexibility is too high and can penalise the mechanical resistance to shocks.

Each blade is thus connected to the hub 18 of the blisk through the central region of its base, which makes it less stiff in bending around the AX axis but also less stiff in torsion about the radial axis that supports it.

This reduction in stiffness, in other words this increase in the flexibility of the blades, particularly at the leading and trailing edges, improves the mechanical resistance of these blades to shocks applied to them following ingestion of a foreign body in the jet.

In practice when such shocks occur, the stress concentration zones are the connection zones of each blade with the upstream face and the downstream face of the hub. These stress concentration zones are shown by the four dotted circles in FIG. 3.

These stress concentrations are limited by advantageously prolonging the blades towards the rotation axis so that they are connected with the offset upstream face and the offset downstream face. These blade prolongations towards the rotation axis AX are shown diagrammatically in FIG. 5, and are referenced as mark P.

Each prolongation P can thus add an additional radial fillet segment from the blade to the hub to increase the total fillet length (measured along the line of the curve), without increasing the fillet connection length projected onto the rotation axis.

Each blade prolongation can thus avoid the formation of stress concentration zones, while making sure that the flexibility of the blades about the AX axis is increased and that the torsional flexibility about the radial axis is increased.

Figure 6:
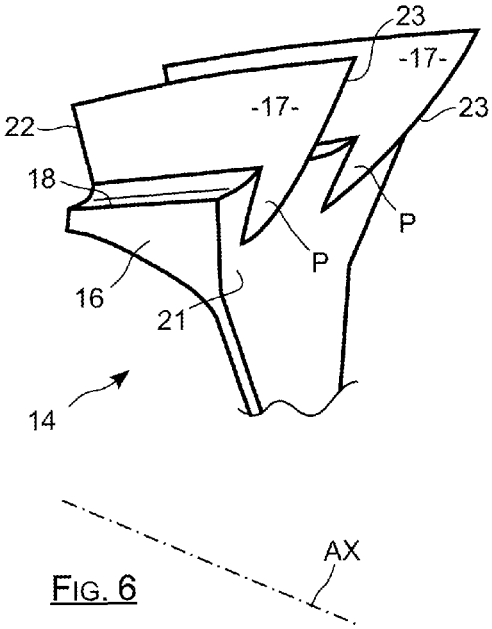
FIG. 6 is a partial three-quarter rear view of a single-piece blisk according to the invention showing an angular sector of this single-piece disk comprising two blades that are provided with prolongations towards the downstream face of the hub.
Figure 7:
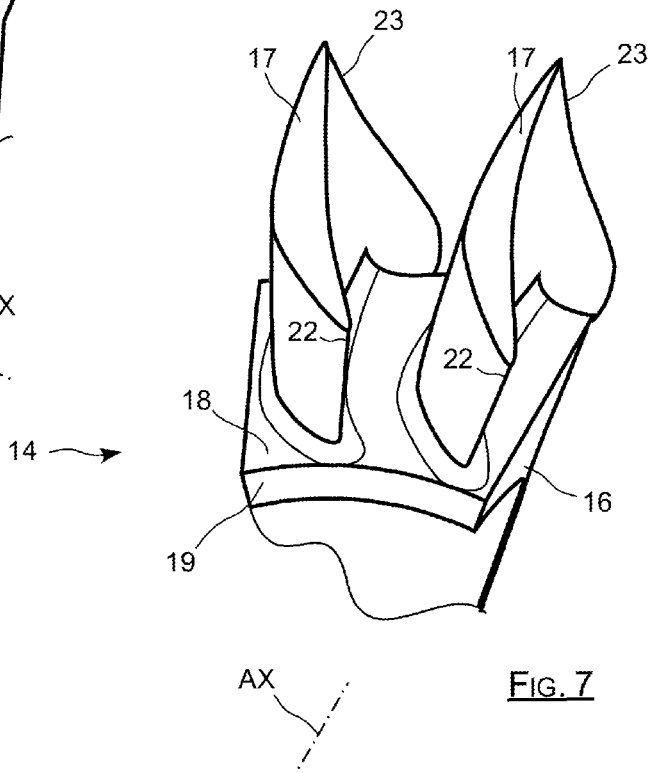
FIG. 7 is a partial three-quarter front view of a single-piece blisk according to the invention showing an angular sector of this single-piece disk comprising two blades that are provided with prolongations towards the downstream face of the hub.

In the embodiment in FIGS. 6 and 7, the downstream part of the hub of the blisk 14 is hollowed out, such that the downstream face 21 is offset so that it is upstream from the trailing edges 23 of the blades 17. Each blade 17 comprises a prolongation P through which it extends towards the rotation AX axis, short of the external peripheral surface 18 of the hub. Each prolongation P forms an extrapolation of the base or the root of the blade, and through which it is progressively connected with the hub.

Each blade 17 thus projects beyond the downstream face 21 to which it is connected, which prevents the appearance of stress concentrations at the connection of each blade with the junction of the external peripheral face and the downstream face. These blades are thus anchored into the hub with increased flexibility to facilitate absorption of energy resulting from shocks in cases in which a foreign body is ingested.

In the example in FIGS. 6 and 7, the hub is hollowed out only at its downstream portion such that only its downstream face 21 is located between the leading and trailing edges of the blades. But as will have been understood, the invention is equally applicable to the region upstream from the blisk at the leading edges and to the region downstream from the blisk at the trailing edges.

In the various examples, each blade is connected to the peripheral face of the hub by a curved region with a first radius of curvature, and each blade prolongation is connected to the upstream and/or downstream face of the hub through another curved portion with a second radius of curvature that may be different from the first.

In general, there is no important stress affecting the choice of the second radius of curvature that may be chosen such that the ratio of the second radius of curvature to the first radius of curvature remains within twenty five hundredths and four.

The invention claimed is:

1. Single-piece fan blisk (14) for a turbofan such as a turbojet, this single-piece blisk (14) comprising a hub (16) with a general shape of revolution about a rotation axis (AX), this hub (16) comprising an external peripheral face (18) extending radially towards the rotation axis (AX) at an upstream face (19) and a downstream face (21) both of which are in the form of rings, this hub (16) supporting blades (17) each comprising a base through which it is connected to an external peripheral face (18) and a leading edge (22) and a trailing edge (23) that are radially oriented, in which the spacing between the upstream face (19) and the downstream face (21) (AX) is less than the distance separating the leading edge (22) from the trailing edge (23) of each blade along the rotation axis, wherein:

the upstream face (19) of the hub (16) is located along the rotation axis (AX) between the leading edges (22) of the blades and the trailing edges (23) of the blades, each blade (17) comprising a first prolongation on the side of its leading edge (22) towards the rotation axis (AX) through which it is connected to the upstream face (19);

and/or in that the downstream face (21) of the hub (16) is located along the rotation axis (AX) between the leading edges (22) of the blades and the trailing edges (23) of the blades, each blade (17) comprising a second prolongation (P) on the side of its trailing edge (23) towards the rotation axis (AX) through which it is connected to the downstream face (21).

2. Blisk according to claim 1, in which the ratio (L1/L2) of the length (L1) separating the leading edge (22) of the blade from the upstream face (19) of the hub (16) divided by the length (L2) separating the leading edge (22) from the trailing edge (23) of the blade, is between two tenths and four tenths.

3. Blisk according to claim 1, in which the ratio (L1'/L2) of the length (L1') separating the trailing edge (23) of the blade from the downstream face (21) of the hub (16) divided by the length (L2) separating the leading edge (22) from the trailing edge (23) of the blade, is between two tenths and four tenths.

4. Blisk according to claim 1, in which the ratio of the sum of the length (L1) separating the leading edge (22) of the blade from the upstream face (19) of the hub and the length (L1') separating the trailing edge (23) of the blade from the downstream face (21) of the hub, divided by the length (L2) separating the leading edge (22) from the trailing edge (23) of the blade, is between two tenths and four tenths.

5. Turbofan fan comprising a disk according to claim 1.

6. Turbojet type aircraft engine, comprising a single-piece blisk according to claim 1.

* * * * *